US007832187B2

(12) United States Patent
Bubar

(10) Patent No.: US 7,832,187 B2
(45) Date of Patent: Nov. 16, 2010

(54) PRODUCE WRAPPING

(75) Inventor: Kevin Keith Bubar, Milton-Freewater, OR (US)

(73) Assignee: Emerald Automation LLC, Kennewick, WA (US)

( * ) Notice: Subject to any disclaimer, the term of this patent is extended or adjusted under 35 U.S.C. 154(b) by 100 days.

(21) Appl. No.: 12/106,813

(22) Filed: Apr. 21, 2008

(65) Prior Publication Data

US 2009/0260334 A1 Oct. 22, 2009

(51) Int. Cl.
*B65B 11/00* (2006.01)

(52) U.S. Cl. ..... 53/465; 53/216

(58) Field of Classification Search ..... 53/587, 53/461, 464, 465, 466, 210, 211, 214–216, 53/220–224, 228, 230–233
See application file for complete search history.

(56) References Cited

U.S. PATENT DOCUMENTS 1,805,306 A * 5/1931 Clark et al. ..... 53/464
2,484,780 A * 10/1949 Clunan et al. ..... 53/450
2,525,649 A * 10/1950 Carson ..... 53/464
2,590,128 A * 3/1952 Sandberg ..... 53/466
2,830,417 A * 4/1958 Ullman et al. ..... 53/464
3,501,892 A * 3/1970 Pikal ..... 53/221
3,591,999 A * 7/1971 Mingotti ..... 53/214
4,624,096 A * 11/1986 Nordstrom ..... 53/228
5,794,410 A * 8/1998 Harper ..... 53/463
2008/0202074 A1 * 8/2008 Frabetti et al. ..... 53/461

FOREIGN PATENT DOCUMENTS

DE 2610404 A * 9/1977
JP 59017953 A * 1/1984
JP 02098508 A * 4/1990

OTHER PUBLICATIONS

"How Toilet Paper Is Made"; Discovery Channel video; http://www.youtube.com/watch?v=wrg_6dnv6Po&feature=related; posted Mar. 26, 2007.

* cited by examiner

*Primary Examiner*—Stephen F Gerrity

(57) ABSTRACT

Exemplary systems and methods relating to produce wrapping are described. One implementation includes first and second conveying devices configured to conform to, and cooperatively convey a produce item over a distance and thereby cause an associated media to be snugly wrapped around the produce item.

18 Claims, 13 Drawing Sheets

PRODUCE WRAPPING

BACKGROUND

Fresh produce such as apples, potatoes and pears, among others, are often wrapped with media for protection and/or presentation to the consumer. For instance, potatoes may be wrapped with metal foil before shipment. Restaurants tend to prefer the foil-wrapped potatoes since they can be baked without additional handling. In another example, produce such as apples and pears are wrapped with paper media for protection during shipment and/or for a more appealing presentation to the consumer. Produce does not lend itself to automated wrapping and instead the wrapping is generally done by hand.

BRIEF DESCRIPTION OF THE DRAWINGS

The accompanying drawings illustrate implementations of the present concepts. Features and advantages of the illustrated implementations can be more readily understood by reference to the following description taken in conjunction with the accompanying drawings.

Like reference numbers and designations in the various drawings are used wherever feasible to indicate like elements.

DETAILED DESCRIPTION

Overview

The present implementations relate to food processing and specifically to wrapping a sheet media around an item of produce. Produce, such as potatoes, cucumbers, apples, oranges, and peaches, among others, can be thought of as perishable, irregularly-shaped food items. Produce is perishable in that it will deteriorate over time due to oxidation and bacterial and/or fungal growth until it is undesired by consumers. Any damage to the produce tends to hasten this deterioration.

Produce can be irregularly-shaped from either, or both, of a macro and a micro perspective. For instance, the macro perspective can be thought of as overall dimensions, such as a maximum length and maximum width for individual produce. For example, even for potatoes sorted by size, some variation can occur in the overall dimensions from potato to potato. Similarly, produce having the same overall dimensions can have micro variations. For instance, even though two potatoes may have the same maximum length and maximum width (i.e., macro perspective) one potato may be relatively circular transverse its length while the other is more flattened (i.e., micro perspective).

Sheet media can be any material, such as paper, metal foil, or plastic, among others, that is wrapped around a produce item for functional and/or aesthetic reasons. For instance, metal foil can be wrapped around a potato to facilitate baking of the potato. In another instance, colored paper can be wrapped around an apple to both protect the apple and to enhance the presentation of the apple.

The present implementations can include wrapping devices for wrapping a sheet media around a produce item. In some cases, the wrapping device can define a wrapping region into which a produce item and a sheet media can be introduced. The wrapping device can transport the produce item and the sheet media through the wrapping region and thereby cause the sheet media to be wrapped around the produce item. The wrapping device is configured so that the wrapping region can accommodate the produce item during its passage by temporarily conforming to, or being defined by, the produce item. Such a configuration promotes satisfactory wrapping of the sheet media around the produce item while reducing damage, such as bruises to the produce item. At least some of the present implementations can satisfactorily wrap the sheet media around the produce item in a snug manner so that the sheet media tends to remain generally wrapped around the produce item upon completion of the wrapping process rather than falling off.

Exemplary Wrapping Systems

Figure 1:
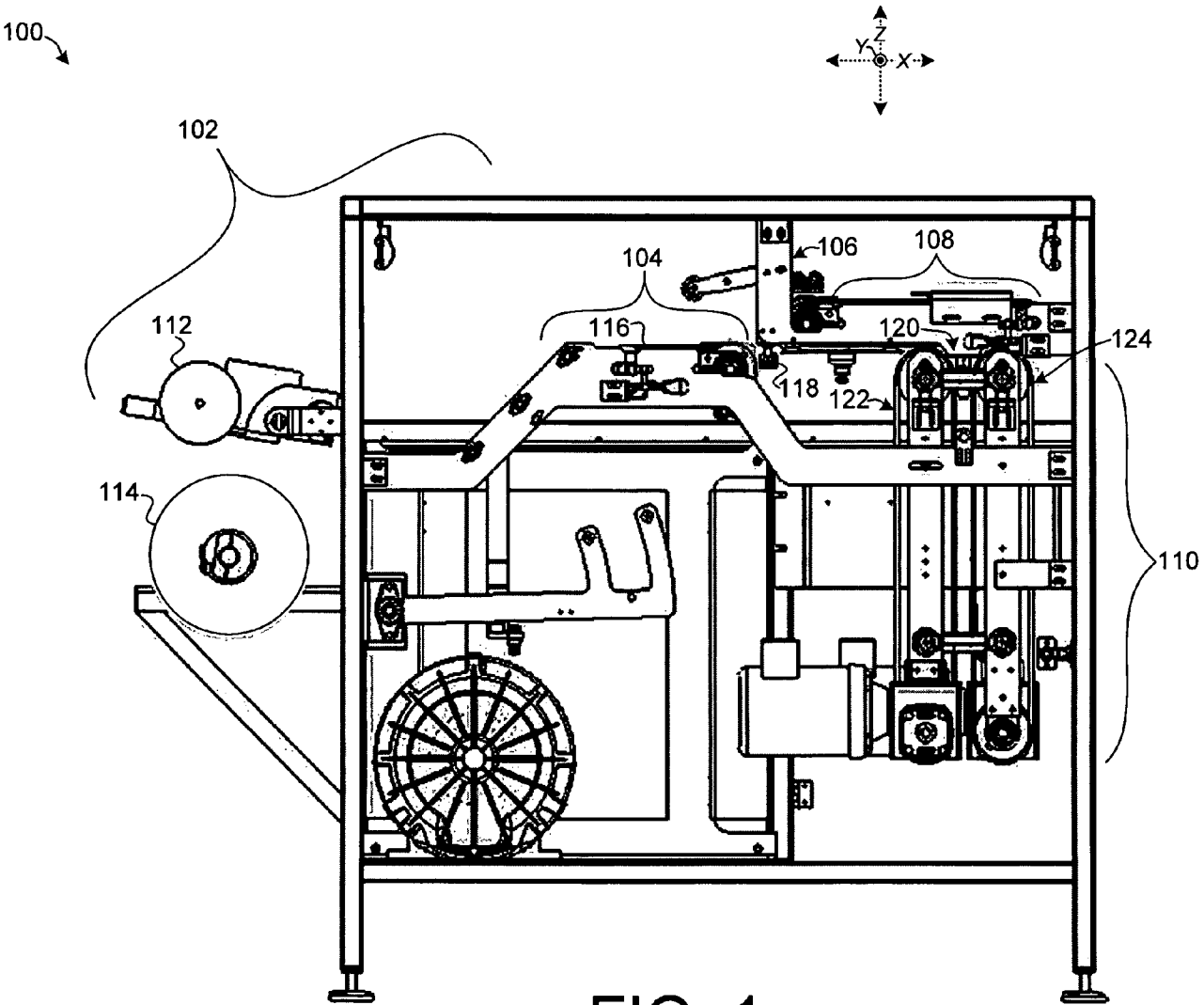
FIG. 1 is a side-view of an exemplary wrapping system in which some of the present concepts can be employed in accordance with some implementations.

FIG. 1 offers an exemplary produce wrapping environment or system 100. In this case, the system generally includes a foil un-winder section or device 102, a first belt section or device 104, a foil cutting section or device 106, a second belt section or device 108, and a wrapping section or device 110. As should become apparent to the skilled artisan from the description below, system 100 offers but one exemplary system in which the present concepts can be employed. For instance, the devices employed in wrapping system 100 can offer but one example of how a particular functionality can be achieved. This example is explained in the context where metal foil is the selected sheet media, but other sheet media, such as paper or plastic can alternatively be employed.

In the configuration of system 100, foil un-winder section 102 includes a motor mechanism 112 that can assist unwinding of a foil roll 114 to provide foil for the remainder of the system. The first belt section 104 can include a belt mechanism 116 for receiving the foil from foil roll 114 and forwarding the foil toward foil cutting section 106. Belt mechanism 116 can include a vacuum plenum (not specifically designated) or other mechanism for releasably securing the foil to the belt mechanism.

In this case, foil cutting section 106 employs a cutting mechanism 118 for cutting a piece of media from the foil roll 114. The cutting mechanism can be employed at given time intervals or after a specified length of foil is forwarded to the second belt section 108 to generate foil sheets of a desired size. The second belt section 108 forwards the newly cut foil sheet over a wrapping region 120 defined by the wrapping device 110. The second belt section can employ a vacuum plenum (not specifically designated) or other mechanism for selectively securing or holding the foil sheet over the wrapping region 120. In this case, wrapping region 120 is defined in part by first and second wrapping belt mechanisms 122 and 124.

A produce item can be placed on the foil sheet at second belt mechanism 108 and the vacuum plenum can be controlled to allow the foil sheet and the produce item to enter the wrapping region 120. Entry of the foil sheet and the produce item into the wrapping region allows the first and second wrapping belt mechanisms 122 and 124 to engage the foil sheet and the produce item. As will be explained in more detail below, the interactions of the wrapping device, the foil sheet, and the produce item function to wrap the foil sheet around the produce item.

Exemplary Wrapping Devices

Figure 2:
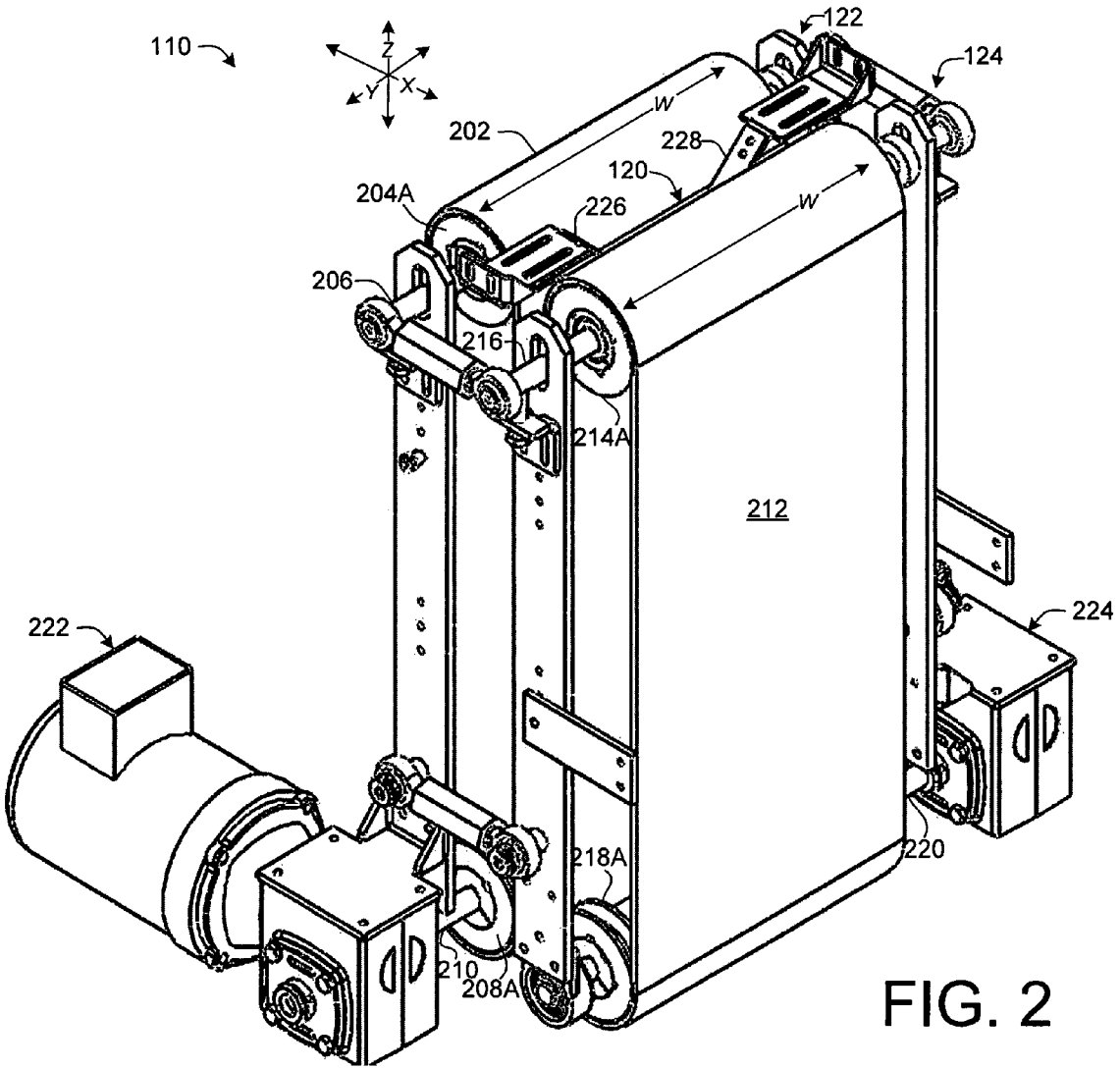
FIGS. 2-4 are perspective views of an exemplary wrapping device in accordance with some implementations of the present concepts.
Figure 3:
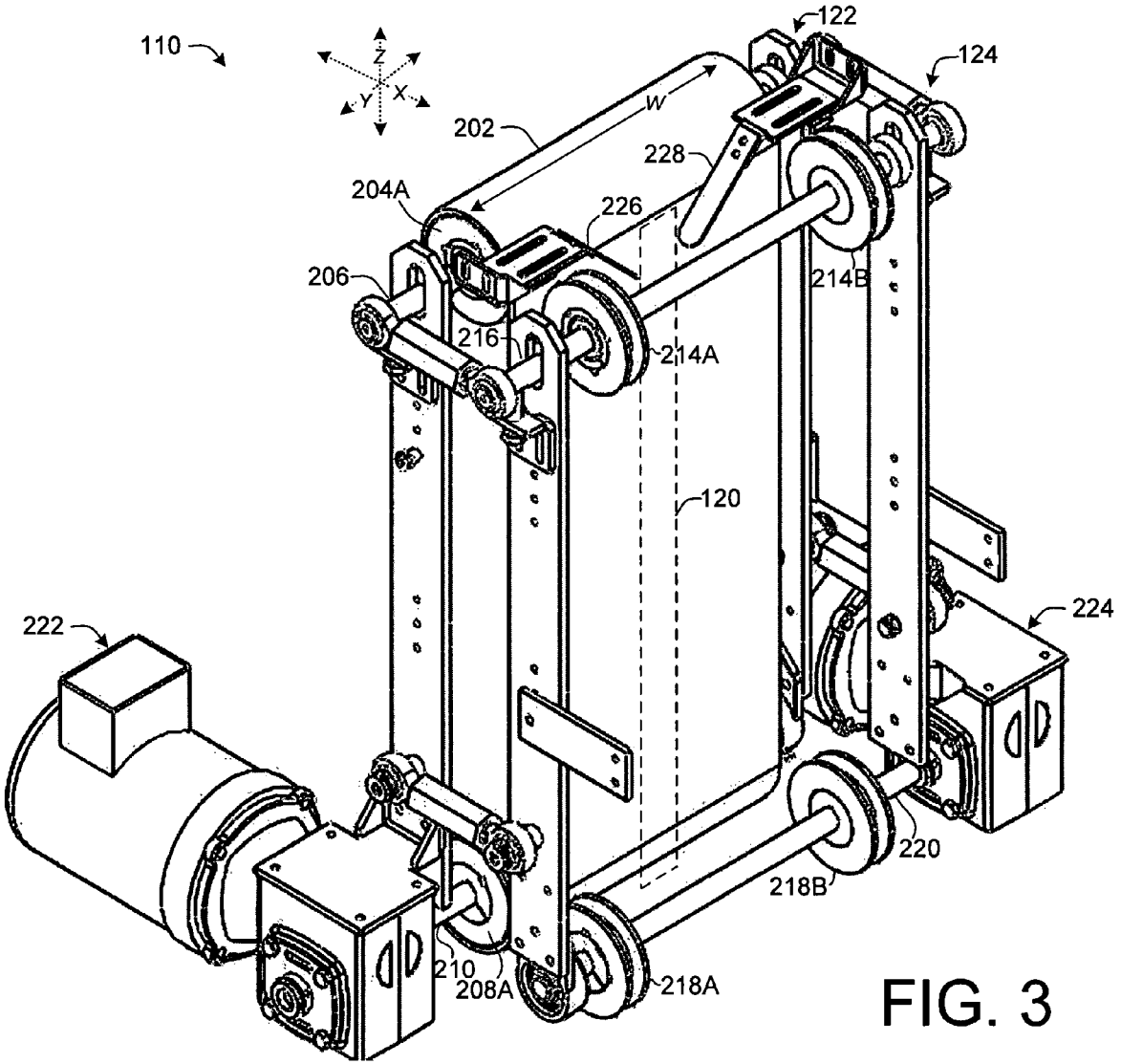

FIGS. 2-5 show more detailed views of the wrapping device 110 of FIG. 1 while other implementations are subsequently discussed. FIGS. 2 and 3 are similar with some components removed in FIG. 3 for purposes of explanation. In this implementation, first wrapping belt mechanism 122 includes a compliant or deformable belt 202, a first pair of pulleys (only one member "204A" of the pair is visible in the FIGS.) positioned on a first axle or idler shaft 206, and a second pair of pulleys (only one member "208A" of the pair is visible in the FIGS.) positioned on a second axle or drive shaft 210. Similarly, second wrapping belt mechanism 124 includes a compliant or deformable belt 212 (removed in FIG. 3), a first pair of pulleys 214A, 214B (FIG. 3) positioned on a first axle or idler shaft 216, and a second pair of pulleys 218A, 218B (FIG. 3) positioned on a second axle or drive shaft 220.

The first wrapping belt mechanism 122 is driven by means of a motor mechanism 222 connected to second axle 210. Similarly, second wrapping belt mechanism 124 is driven by means of a motor mechanism 224 connected to second axle 220.

In this implementation, compliant belts 202 and 212 extend generally parallel to one another and generally parallel to a "Z" reference axis. Compliant belts 202 and 212 further serve to partially define wrapping region 120 therebetween. Compliant belts 202 and 212 are compliant in that they can be temporarily deformed or displaced parallel to an "X" reference axis by passage of a produce item as will be described in more detail below in relation to FIGS. 7-8. Viewed another way, the compliant belts can be deformed along their width "W" by a produce item where the width "W" lies parallel to a "Y" reference axis. Such a configuration can contribute to continually centering a passing produce item in the wrapping region 120.

In this configuration, the compliant belts 202, 212 are generally parallel in that the portions of the compliant belts that define wrapping region 120 extend generally parallel to one another. Stated another way, the compliant belts are generally parallel to one another along their length "L" (designated with specificity in FIG. 7). In other configurations the compliant belts may or may not be parallel. For instance, the belts could be in oriented in an oblique manner. In one such case, a distance between the compliant belts at an upper portion of wrapping region 120 and measured parallel the "X" reference axis is greater than a distance at a lower portion of the region. Such an example is described below in relation to FIG. 8.

In this case, the wrapping region 120 is further defined parallel to the "Y" reference axis by two opposing media tuckers 226 and 228. The media tuckers function to dispose portions of the media toward the produce. For instance, portions of the media extending generally parallel to a width of the compliant belts can be disposed toward the produce item by the media tuckers.

The media tuckers 226 and 228 can be rigid or flexible in relation to passage of a produce item. For example, spring-biased hinge mechanisms can be utilized in mounting the media tuckers to other portions of the wrapping device 110 so that the media tuckers can deflect out of the way to allow the passage of a produce item that might otherwise jam between the media tuckers. Another implementation can utilize media tuckers constructed of flexible materials, such as plastic, so that the media tuckers can deflect upon passage of a produce item. The media tuckers 226 and 228 can also contribute to centering the produce item in the wrapping region 120.

Figure 5:
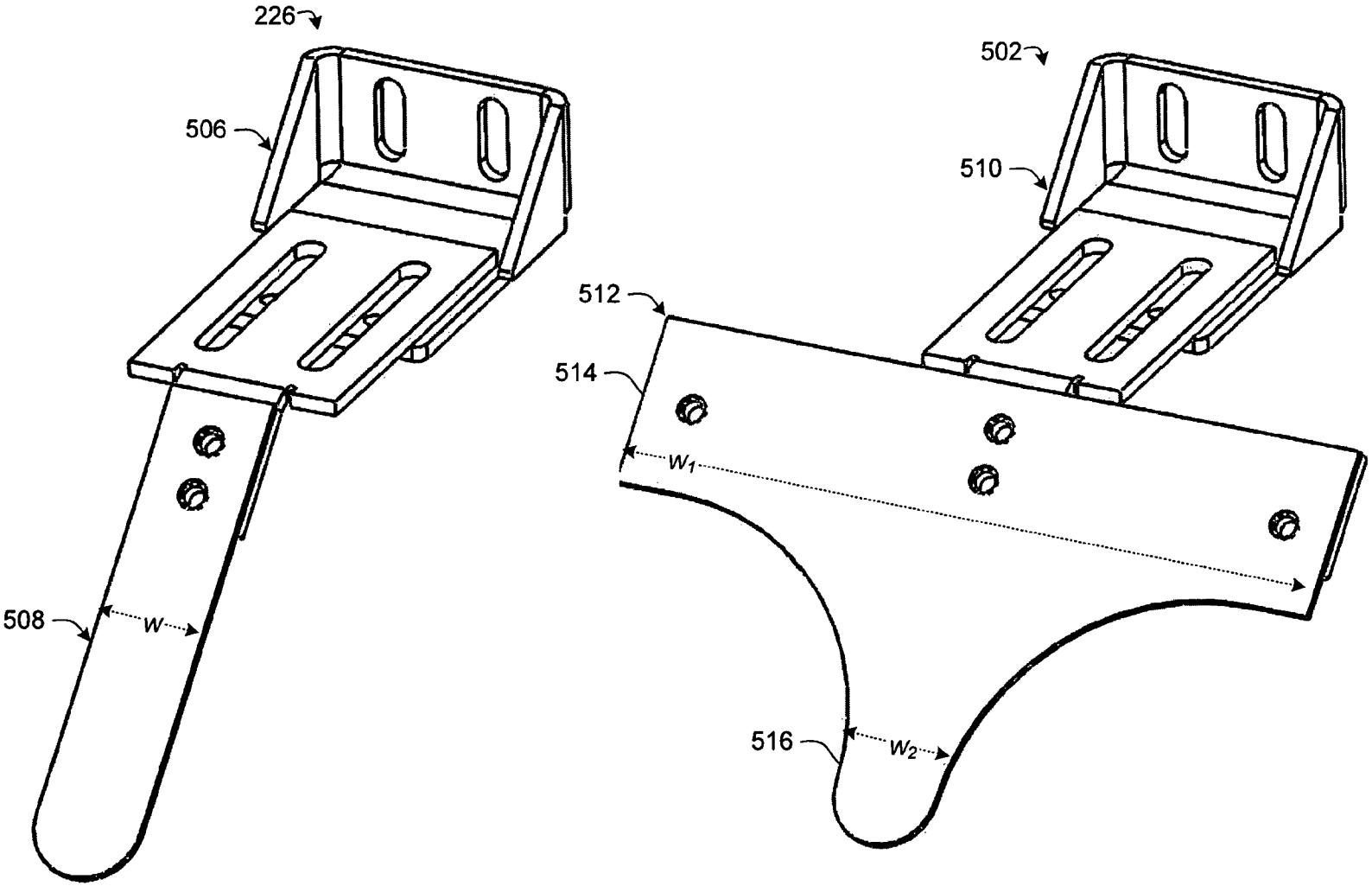
FIG. 5 is a perspective view of a component of an exemplary wrapping device in accordance with some implementations of the present concepts.

FIG. 5 shows a more detailed view of media tucker 226 and an alternative media tucker 502. Media tucker 226 includes a mounting portion 506 and a produce engaging portion 508. In this configuration, produce engaging portion 508 has a width "W" that allows the entire portion to be positioned between the compliant belts (FIG. 2).

Media tucker 502 includes a mounting portion 510 and a produce engaging portion 512. In this case, the produce engaging portion 512 is configured so that an upper area 514 with a relatively wide width "$W_1$" is configured to remain above the compliant belts (FIGS. 2-4) while a lower area 516 has a relatively narrow width "$W_2$" and is configured to extend down between the compliant belts. The upper area 514 can serve to center the produce item so that the produce item enters the wrapping region (FIG. 2) centered along a width of the compliant belts. The lower area 516 functions to displace the media inwardly towards the produce item when viewed parallel to the "Y" reference axis.

Figure 4:
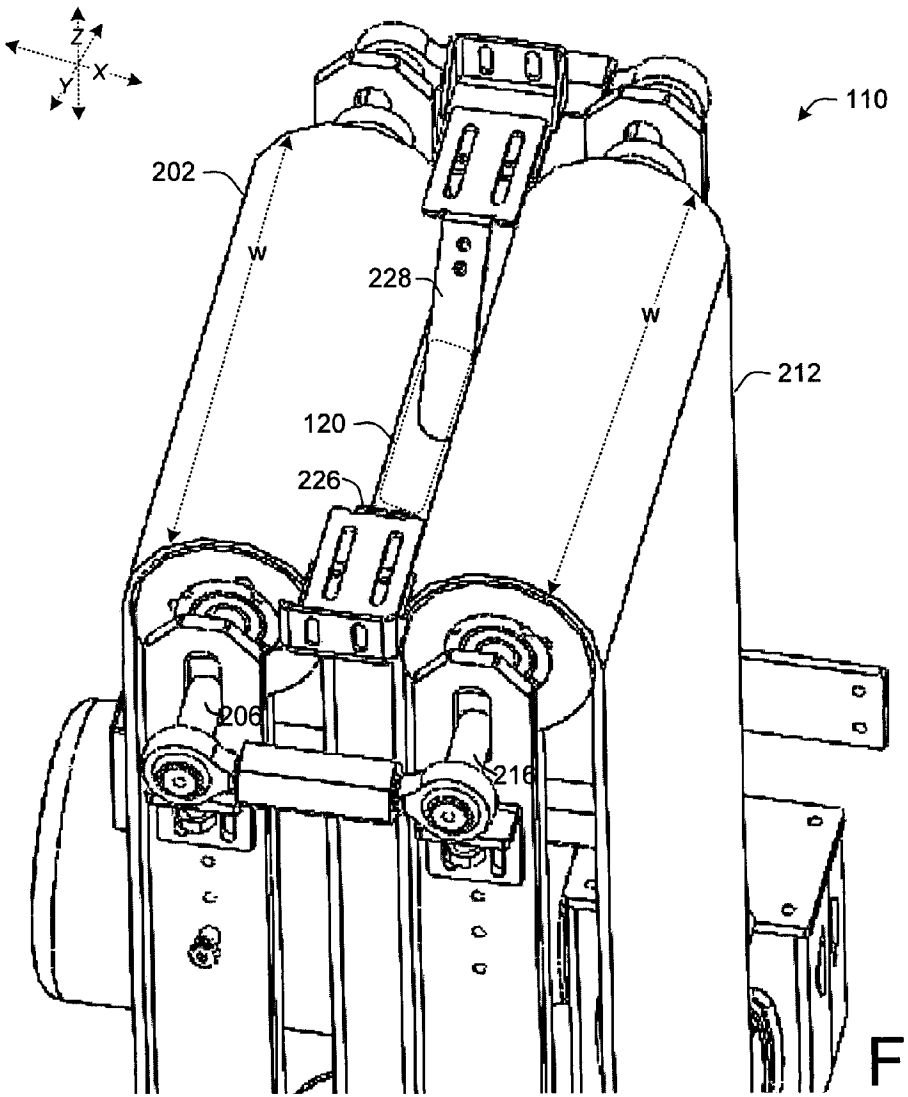
Figure 6:
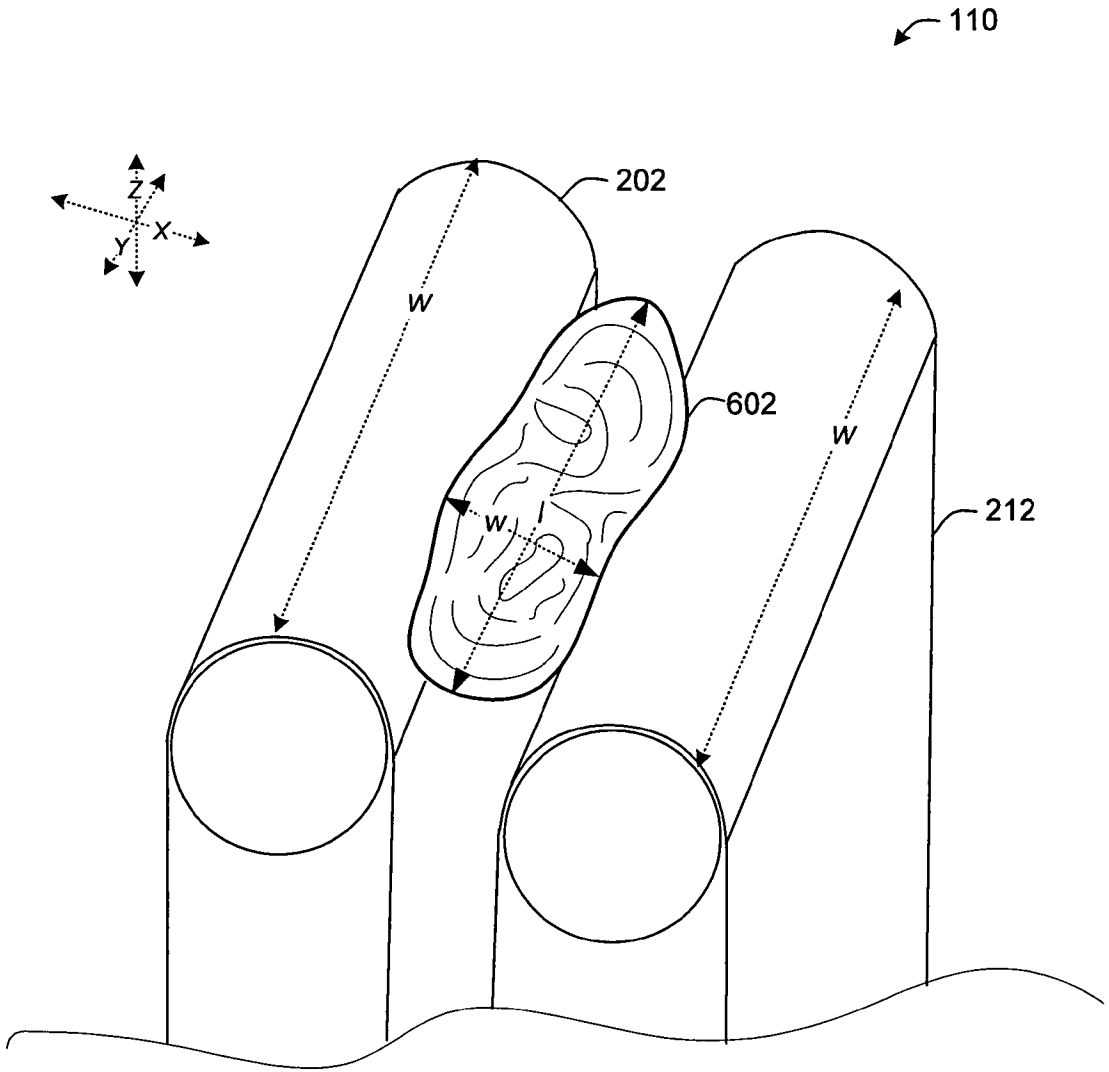
FIG. 6 is a perspective view of an exemplary wrapping device in accordance with some implementations of the present concepts.

FIG. 6 shows a perspective view of wrapping device 110 similar to the view of FIG. 4. In FIG. 6 a produce item 602 is positioned just above the compliant belts 202 and 212. In this case, produce item 602 extends along a length "L" and a width "W" that extends orthogonally to the length. The produce item's width "W" can vary when measured at points along the length "L" and/or can vary when measured at different orientations at a specific point on the length "L" (i.e., micro perspective). In this instance, the produce item 602 is oriented so that its length "L" extends parallel to the width "W" of the compliant belts 202, 212. However, such need not be the case. In some instances, the produce item can be introduced into the wrapping device in a different orientation or without any predetermined orientation. For ease of illustration, sheet media is not illustrated in FIG. 6, but is shown below in relation to FIG. 7.

Figure 7:
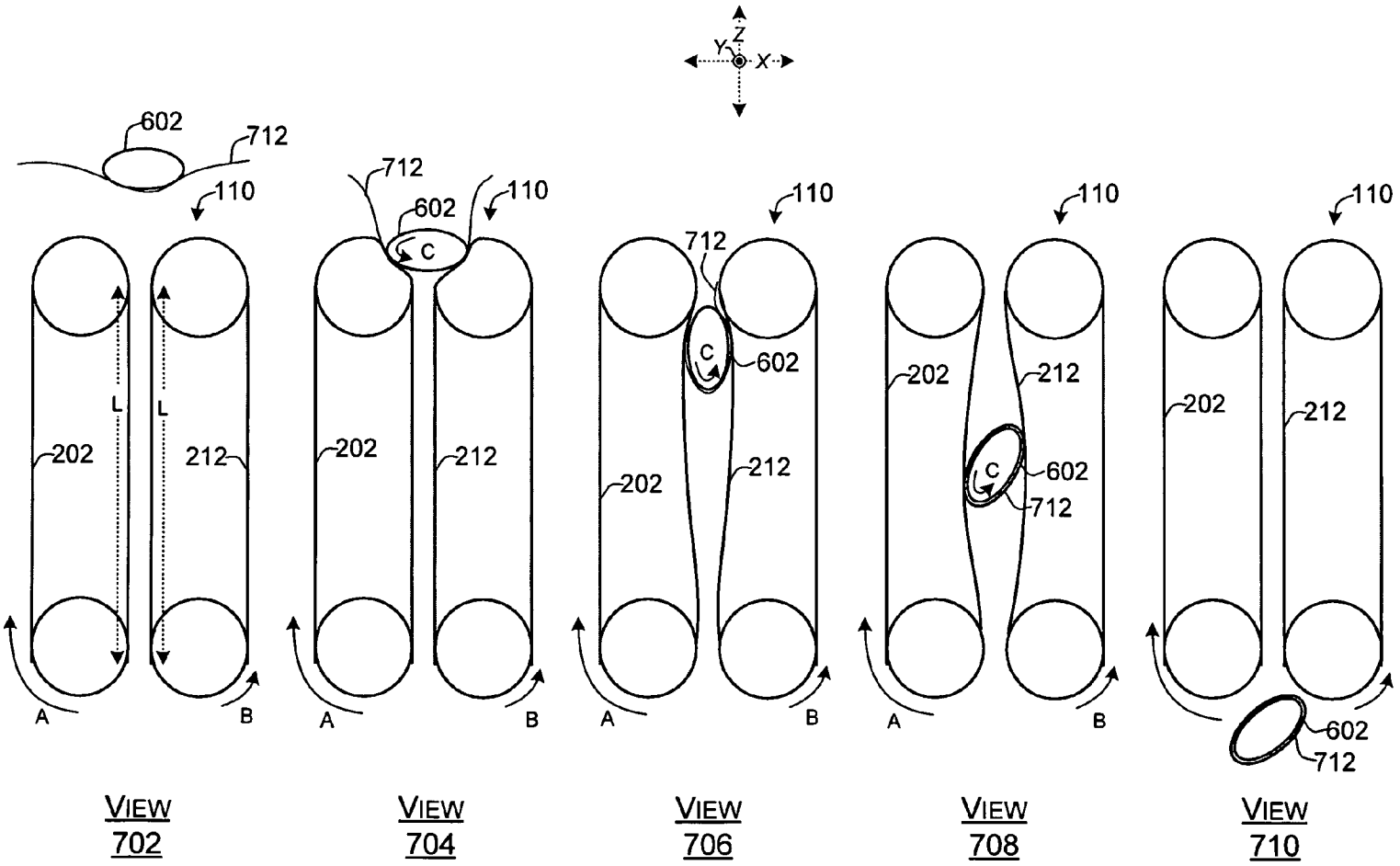
FIGS. 7-8 are simplified side views of exemplary wrapping devices in accordance with some implementations of the present concepts.

FIG. 7 shows a series of five simplified sequential views (702, 704, 706, 708, and 710) of wrapping device 110 showing the wrapping process of a sheet media 712 around produce item 602. The orientation of wrapping device 110 in FIG. 7 is similar to the orientation of FIG. 1. Stated another way, these views are taken along a plane that lies parallel to a plane containing the "X" and "Z" reference axes. In this case, produce item 602 is shown along its width "W" as designated in FIG. 6. The produce item 602 passes along a length "L" of compliant belts 202, 212 that extends parallel to the "Z" reference axis.

As can be appreciated from view 702, a sheet media 712 and produce item 602 are positioned over wrapping device 110. The sheet media 712 and produce item 602 are engaged by compliant belts 202 and 212 in view 704. In this case, both of the compliant belts 202, 212 are spinning as indicated by arrows "A", "B", respectively. In this configuration, compliant belt 202 is spinning at a faster rate than compliant belt 212. In other implementations, the belts can be spun at the same rate as one another. Still in other implementations, one of the belts can be spun in an opposite rotation to the relative rotation of FIG. 7 as indicated by arrows "A", "B". In still other implementations one of the compliant belts can be stationary (i.e., not driven by a motor mechanism) while the other compliant belt is spun or driven by a motor mechanism (shown FIG. 2).

In view 704, produce item 602 and sheet media 712 engage the compliant belts 202, 212. The compliant belts (or portions thereof) are temporarily displaced or deformed by passage of the produce item. The moving or spinning compliant belts 202, 212 cause the produce item 602 to rotate as indicated by arrow "C" and to move downwardly between the belts parallel to the "Z" reference axis as evidenced from views 706 and 708. Ultimately, the media wrapped produce item 602 emerges from the bottom or opposite end of the wrapping device as evidenced from view 710.

The rotation "C" of the produce item 602 causes the sheet media 712 to be wrapped around the produce item as the produce item passes through the wrapping region. The compliant nature of compliant belts 202, 212 tends to reduce damage, such as bruises of the produce item during the wrapping process. Further, the deformation of the compliant belts by the passage of the produce item fosters snug wrapping of the sheet media around the produce item by the wrapping device 110. Snug wrapping tends to increase a likelihood that the media will stay wrapped once the produce item exits the wrapping region.

In this case, wrapping device 110 is oriented vertically (i.e., the wrapping region designated in FIGS. 2-4 is oriented vertically). The vertical orientation allows gravitational effects to pull the sheet media 712 and the produce item 602 toward the wrapping device. In other configurations, the sheet media 712 and the produce item 602 can be physically engaged into or toward the compliant belts by a feeding mechanism. In other configurations, the wrapping device can be oriented horizontally or obliquely relative to the vertical orientation shown here in FIG. 7.

Figure 8:
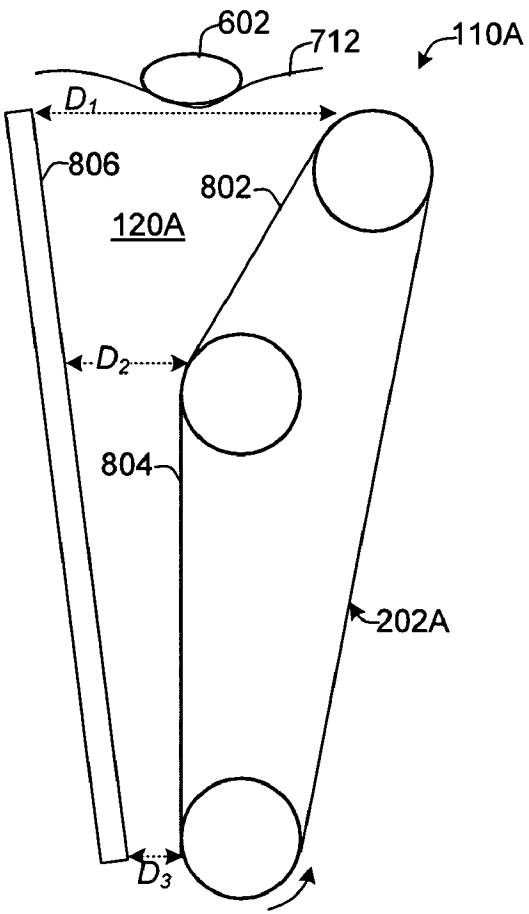

FIG. 8 shows an alternative configuration of a wrapping device 110A. In this case, wrapping region 120A is defined between surfaces 802 and 804 of compliant belt 202A and a fixed surface 806. In this configuration, fixed surface 806 is oblique relative to the compliant belt's surfaces 802 and 804. Fixed surface 806 can be relatively rigid or relatively compliant depending on the type of produce to be wrapped and the properties of compliant belt 202A.

The configuration of wrapping device 110A offers a relatively large entrance gap or distance "$D_1$" to accept different sizes of produce items. The relatively wide distance "$D_1$" also allows greater tolerances for positioning the produce item 602 and sheet media 712 over the entrance defined by distance "$D_1$". Considered another way, a produce item that is not well centered over the wrapping region's entrance distance "$D_1$" will still tend to enter the wrapping region and be successfully wrapped.

In this case, wrapping region 120A quickly tapers from distance "$D_1$" to a distance "$D_2$". Further taper between distance "$D_2$" and an exit distance "$D_3$" is more gradual to facilitate the wrapping process. For instance, compliant belt 202A imparts a rolling action upon produce item 602. As produce item 602 and sheet media 712 are squeezed between surface 804 and 806 the rolling action tends to snuggly wrap the sheet media around the produce item.

Figure 9:
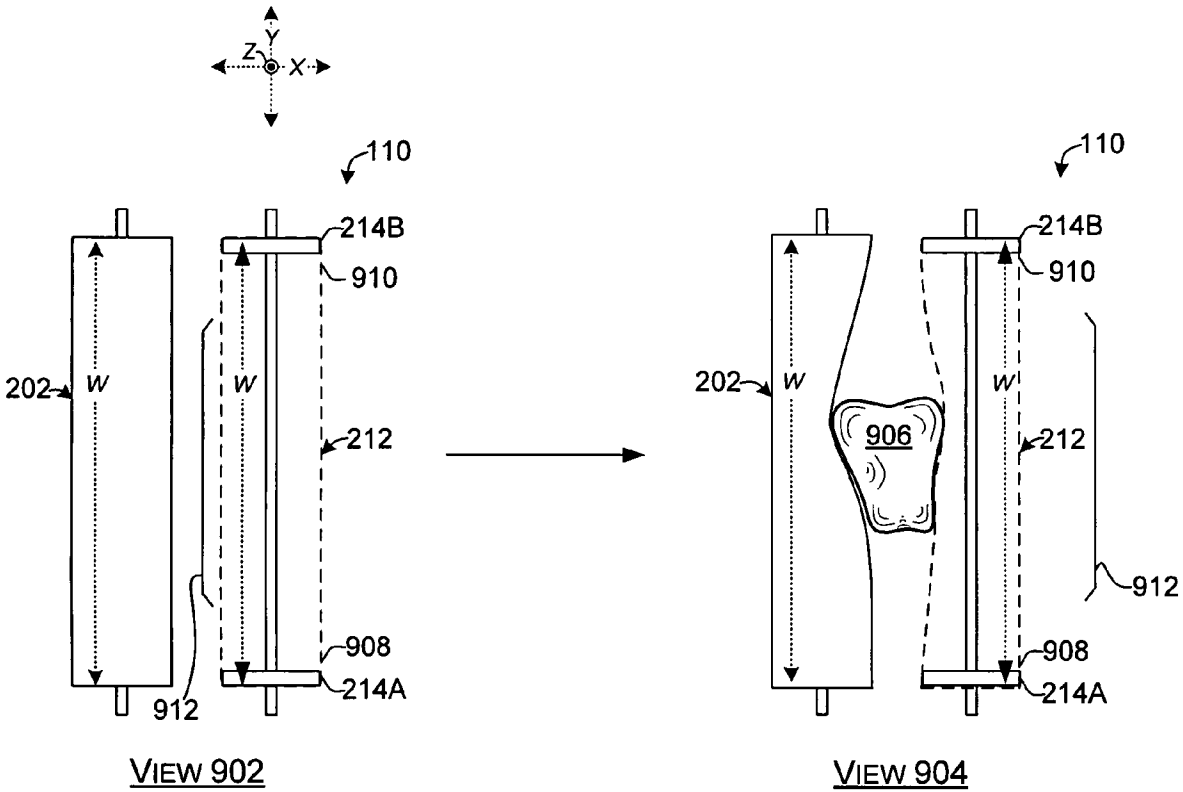
FIGS. 9-12 are simplified top views of exemplary wrapping devices in accordance with some implementations of the present concepts.

FIG. 9 shows two top views 902, 904 of wrapping device 110 taken along the "Z" reference axis. In this case, compliant belt 212 is shown in ghost to allow visualization of underlying components while compliant belt 202 is shown in a standard format for comparison.

View 902 shows compliant belts 202, 212 without any associated produce items. View 904 shows compliant belts 202, 212 in the presence of a produce item 906 that, in this instance, is embodied as an apple. In this configuration, the compliant belts are only supported at the two opposing distal edges defining their width "W". For instance, compliant belt 212 is supported at distal edge 908 by pulley 214A and at distal edge 910 by pulley 214B.

In view 902, interposed portions 912 of compliant belt 212 maintain a generally linear configuration due to the property of the belt itself and/or due to centripetal forces caused by the rotation of the compliant belt. Contrastingly, in view 904, the interposed portions 912 are deflected inwardly by the passage of the produce item 906.

The extent of the inward deflection parallel to the "X" reference axis of the compliant belts 202, 212 is controlled by the shape of the produce item 906. Further, the portions of the compliant belts toward the center as defined between the distal edges 908, 910 tend to deflect more easily (i.e., with less force). Accordingly, this configuration tends to promote centering of the produce item 906 relative to the width of the compliant belts. Correspondingly, this configuration can reduce the chance of the produce item being damaged by passing between opposing pulleys or from being ejected from the side (along the "Y" reference axis) of the wrapping device.

Figure 10:
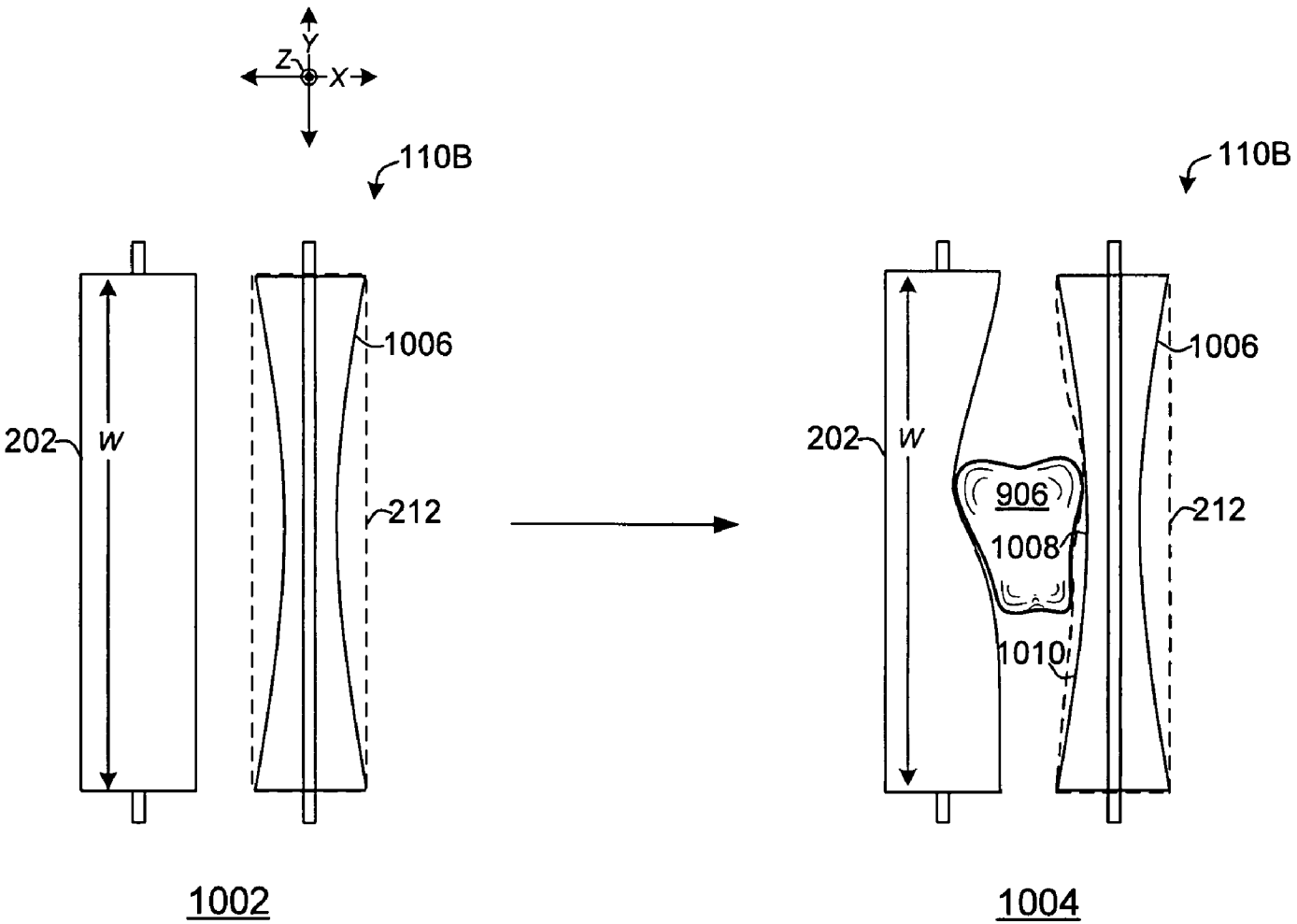

FIG. 10 shows two top views 1002, 1004 of an alternative wrapping device 110B taken along the "Z" reference axis similar to the views of FIG. 9. In this case, compliant belt 212 is shown in ghost to allow visualization of underlying components while compliant belt 202 is shown in a standard format for comparison.

View 1002 shows compliant belts 202, 212 without any associated produce items. View 1004 shows compliant belts 202, 212 in the presence of produce item 906. In this configuration, each of the compliant belts 202, 212 is supported by a single pulley along its width "W". For instance, compliant belt 212 is supported by a pulley 1006.

The pulley 1006 is contoured across the width of the belt. Accordingly, when there is no produce item in the wrapping device 110A the compliant belt may only engage pulley 1006 at the edges of the belt. Such an example is provided in view 1002. Contrastingly, when a produce item 906 passes through the wrapping device, the compliant belts may be deflected until they touch the pulley at one or more interposed positions. In such a configuration, the contour of the pulley can define the maximum deflection for various regions of the compliant belt. For instance, in view 1004, compliant belt 212 can deflect farther at a midpoint 1008 that at another point 1010 that is relatively closer to the edge of the compliant belt. Such a configuration can contribute to centering produce items along the width "W" of the compliant belts.

Figure 11:
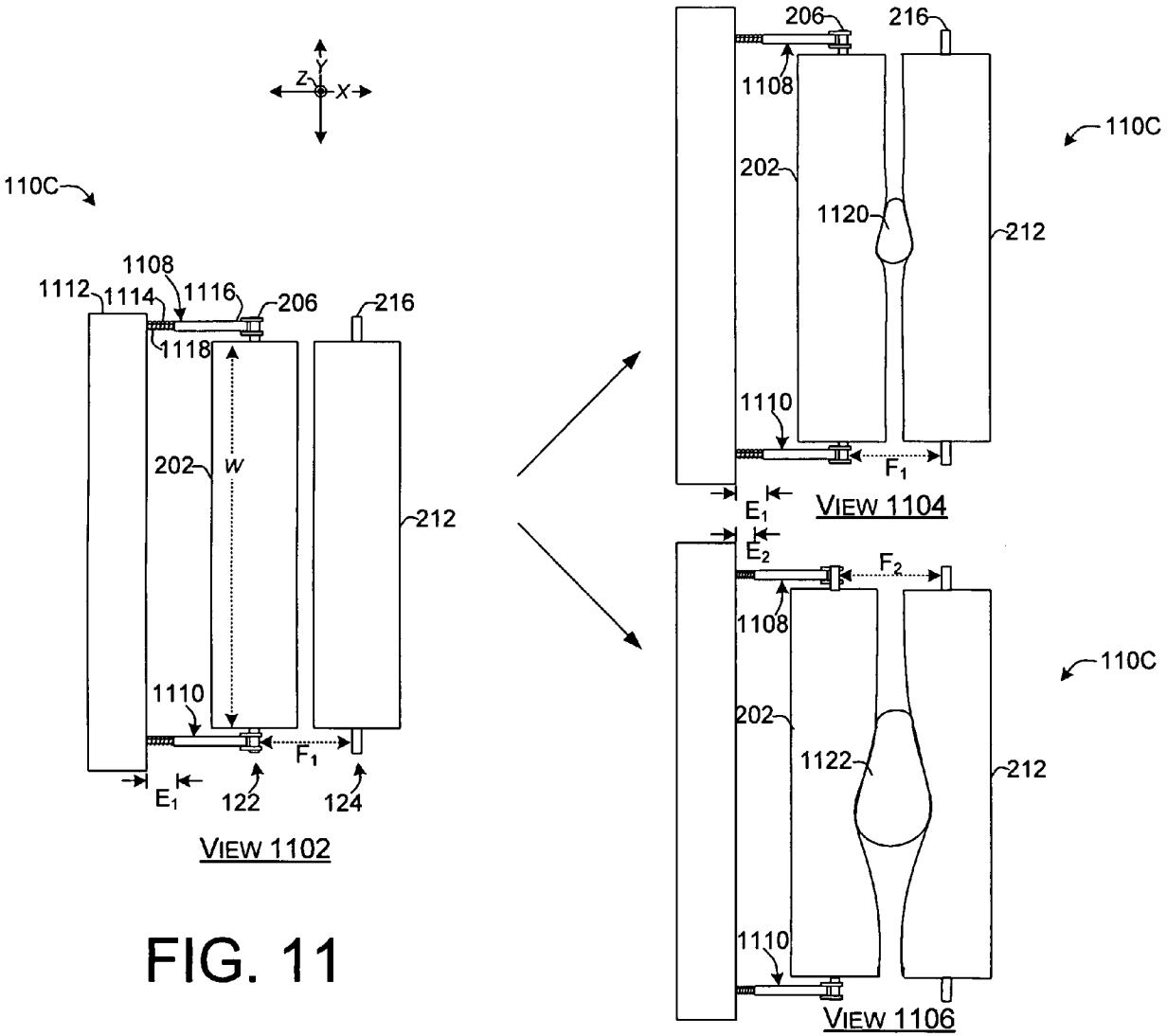

FIG. 11 shows another wrapping device 110C. FIG. 11 shows three views 1102, 1104, and 1106 of wrapping device 110B that are similar to the views of FIGS. 9 and 10. The wrapping device is empty of any produce items in view 1102. Wrapping device 110C is in the process of wrapping produce items in views 1104, 1106.

In this case, the wrapping device's first and second wrapping belt mechanisms 122 and 124 are resiliently biased toward one another to accommodate different sizes of produce items. In this particular instance, the first and second wrapping belt mechanisms are resiliently biased toward one another via spring loaded piston mechanisms 1108 and 1110. Here, the spring loaded piston mechanisms are connected to axle 206 associated with compliant belt 202 of first wrapping belt mechanism 122. In this case, the spring loaded piston mechanisms 1108 and 1110 are mounted between a stationary member 1112 and axle 206. In this configuration, the spring loaded piston mechanisms include a rod 1114 that slides within a tube 1116. Rod 1114 is outwardly biased from tube 1116 by a coextensive spring 1118. In addition to spring loaded configurations, the piston mechanisms can be pneumatic or motor driven, among others.

In the empty condition of view 1102, spring 1118 extends to a distance $E_1$ and further defines a distance $F_1$ between axles 206, 216. View 1104 shows a relatively small produce item, such as a pear 1120 entering the wrapping device 110C. In this scenario, distance "$E_1$" and distance "$F_1$" may be generally maintained from the empty configuration of view 1102. In this case, the compliant belts 202, 212 can conform to pear 1120 without exerting undue forces on the pear.

View 1106 shows a relatively large produce item, such as a pear 1122 entering the wrapping device 110C. In this case, the resilient bias allows compliant belt 202 of wrapping belt mechanism 122 to be moved parallel to the "X" reference axis by the pear 1122. In this scenario, the spring loaded pistons 1108, 1110 are compressed as evidenced in that displacement "$E_2$" is less than displacement "$E_1$". Compressing the spring loaded pistons increases the relative distance between the compliant belts from $F_1$ to distance "$F_2$". In this configuration, deflection of the compliant belts and/or compression of the spring loaded pistons by the passage of the produce item can produce a force on the produce item that contributes to snuggly wrapping the sheet media around the produce item.

In light of the above description, the skilled artisan should recognize other biasing mechanisms that achieve similar biasing functions for a wrapping device. The skilled artisan should also recognize that the resilient bias functionality can be utilized in other implementations. For instance, the resilient bias functionality can allow relatively more rigid belts and/or surfaces to engage a produce item with a reduced risk of damaging the food item.

Figure 12:
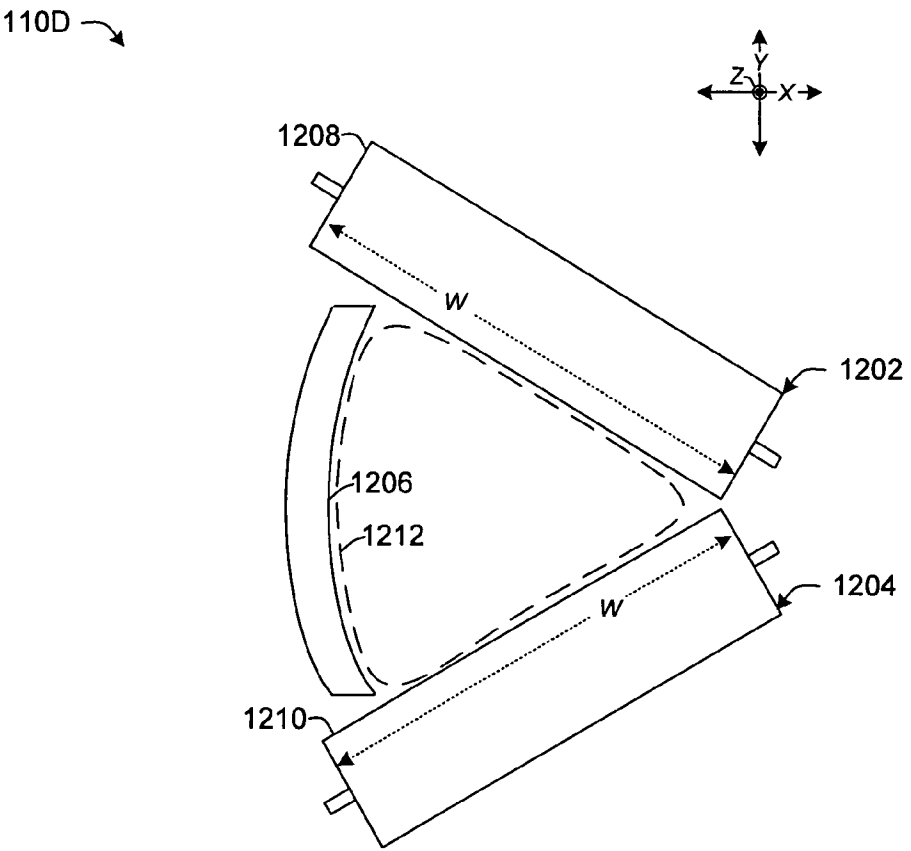

FIG. 12 shows another wrapping device 110D. FIG. 12 is a top view similar to the views of FIGS. 9-11. In this case, wrapping device 110D includes two wrapping belt mechanisms 1202, 1204 for engaging a produce item collectively with a rigid surface 1206. In this implementation, wrapping belt mechanism 1202 includes a compliant belt 1208 and wrapping belt mechanism 1204 includes a compliant belt 1210. In this configuration, compliant belt 1208 is oriented obliquely relative to compliant belt 1210 when viewed parallel the "Z" reference axis.

Rigid surface 1206 is curved relative to the "Y" reference axis in this implementation. The curved nature of the rigid surface can aid in centering produce items within a wrapping region 1212. Further, in light of the above description, examples, and FIGURES, the skilled artisan should recognize that different sizes, orientations, and/or numbers of belts, surfaces, and/or equivalents can be utilized to define a wrapping region for wrapping a sheet media around a produce item in various implementations of the present concepts.

The skilled artisan should recognize that the above described concepts can be employed with wrapping devices other than those described above in relation to FIG. 1. For instance, these concepts can be employed with wrapping devices that achieve similar functionalities to those described in relation to FIG. 1, but which employ different mechanisms to achieve the functionalities. In still other scenarios, the present concepts can be employed with wrapping devices that differ both in form and function from the wrapping device of FIG. 1.

Exemplary Method

Figure 13:
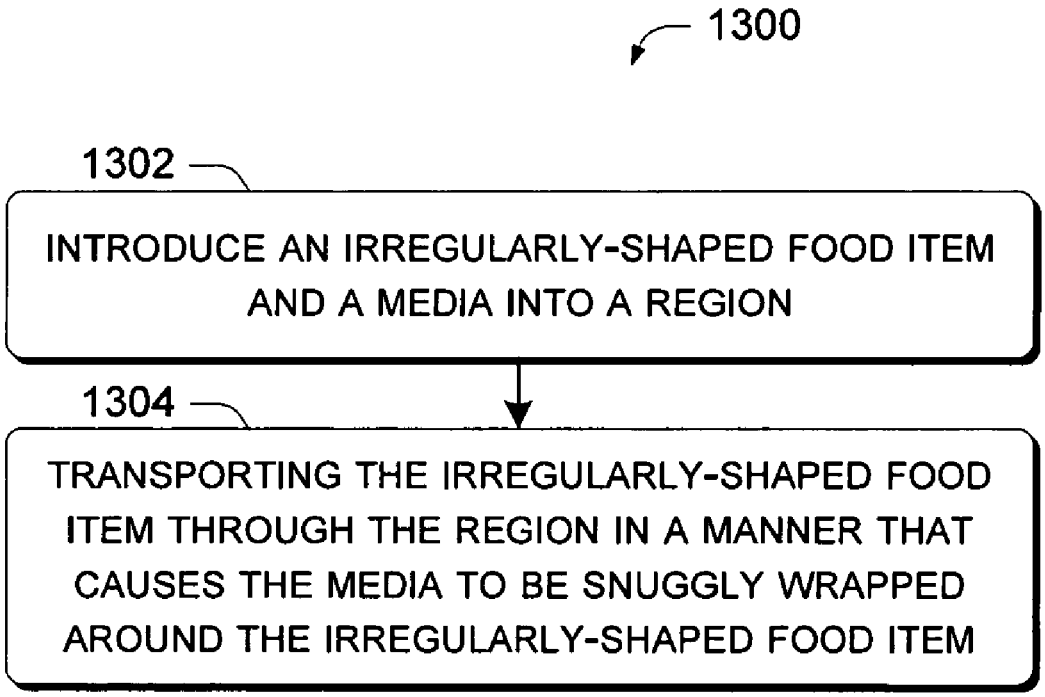
FIG. 13 is a flow chart of an exemplary method for produce wrapping in accordance with some implementations of the present concepts.

FIG. 13 shows an exemplary process or method 1300 for wrapping a produce item. The order in which the method 1300 is described is not intended to be construed as a limitation, and any number of the described blocks can be combined in any order to implement the method, or an alternate method. Furthermore, the method can be implemented in any suitable hardware, software, firmware, or combination thereof such that a computing device can implement the method. In one case, the method is stored on a computer-readable storage media as a set of instructions such that execution by a computing device causes the computing device to perform the method. For instance, the wrapping system of FIG. 1 can include, or be controlled by, a computing device that causes an exemplary method to be performed.

At block 1302, a produce item and a media are introduced into a region. In some cases, block 1302 can be automated such that a computing device can cause the produce item and the media to be introduced into the region. In other cases, this block can be performed manually by a human.

At block 1304, the produce item is transported through the region in a manner that causes the media to be snuggly wrapped around the produce item. In some cases the transporting is accomplished by engaging the produce item and the media with a moving surface. The moving surface can impart a rolling action upon the produce item that causes the media to be wrapped around the produce item.

In some cases, the moving surface can be relatively compliant or deformable around the produce item. Examples of such a configuration are evidenced above in relation to FIGS. 9-10. Such a configuration can reduce damage, such as bruises to the produce item. Alternatively or additionally, the moving surface can be resiliently disposed toward the produce item. One such example is described above in relation to FIG. 11. In some configurations the moving surface can cause the produce item to move through the region along a single axis. In other cases, the produce item may wobble between various axes or may roll in a random or changing manner during the wrapping process.

CONCLUSION

Exemplary techniques, methods, devices, systems, etc., relating to wrapping produce items have been described. The inherent properties of produce items, such as their irregular-shape and perishable nature, do not lend themselves to automated wrapping. The described concepts address these inherent properties to successfully automate the wrapping process. While the present concepts are described in language specific to structural features and/or methodological acts, it is to be understood that the subject matter defined in the appended claims is not necessarily limited to the specific features or acts described. Rather, the specific features and acts are disclosed as exemplary forms of implementing the claimed methods, devices, systems, etc.

What is claimed is:

1. A system, comprising:

first and second generally opposing conveying devices and a pair of opposing deflectable media tuckers positioned at a right angle to the first and second conveying devices, the first and second generally opposing conveying devices configured to conform to, and cooperatively convey a produce item over a distance and thereby cause an associated media to be snugly wrapped around the produce item.

2. The system of claim 1, wherein individual conveying devices comprise a belt and a set of belt pulleys and wherein individual belt pulleys are concave when viewed transverse an axis of rotation.

3. The system of claim 1, wherein the first conveying device comprises a first belt and the second conveying device comprises a second belt and wherein the first and second belts have equal widths and equal lengths.

4. The system of claim 1, wherein the first conveying device comprises a first belt having a width and the second conveying device comprises a second belt having a width and wherein the width of the first belt extends generally parallel to the width of the second belt.

5. The system of claim 4, wherein the first belt has a length for engaging the produce item and wherein the second belt has a length for engaging the produce item and wherein the two lengths are parallel and equal.

6. A system, comprising:

multiple surfaces that define a wrapping region therebetween, wherein at least one of the surfaces is moveable for rolling an irregularly-shaped perishable food item through the wrapping region and at least one of the surfaces is configured to conform to the irregularly-shaped perishable food item during the rolling effective to wrap a sheet media around the irregularly-shaped perishable food item, wherein the multiple surfaces comprise a pair of opposing moveable belts and a pair of fixed but deflectable surfaces that are orthogonal to the pair of opposing moveable belts.

7. The system of claim 6, wherein an individual opposing moveable belt is configured to move along a length of an individual surface and wherein the individual opposing moveable belt is deflectable along a width such that a central portion of the individual opposing moveable belt as viewed along the width is more deflectable than more distal portions of the individual opposing moveable belt to allow the individual opposing moveable belt to conform to the irregularly-shaped perishable food item.

8. The system of claim 6, wherein the multiple surfaces comprise additional belts other than the pair of opposing moveable belts.

9. The system of claim 6, wherein a first belt of the pair of opposing moveable belts moves along a length that defines an individual surface and wherein the second belt of the pair of opposing moveable belts moves along another length that defines another individual surface and that lies generally parallel to the individual surface defined by the first belt.

10. The system of claim 6, wherein the multiple surfaces are oriented one or more of: horizontally, vertically, and obliquely therebetween.

11. The system of claim 6, wherein the wrapping region is tapered from an entrance point to an exit point.

12. A method, comprising:

introducing an irregularly-shaped produce item and a sheet media into a region that is defined by a pair of opposing moveable belts and a pair of fixed but deflectable surfaces that are orthogonal to the pair of opposing moveable belts; and, transporting the irregularly-shaped produce item through the region in a manner that causes the sheet media to be snuggly wrapped around the irregularly-shaped produce item.

13. The method of claim 12, wherein the introducing comprises positioning the irregularly-shaped produce item on the sheet media and allowing gravity to pull the irregularly-shaped produce item and the sheet media into the region.

14. The method of claim 12, wherein the introducing is performed by a human.

15. The method of claim 12, wherein the transporting comprises rolling the irregularly-shaped produce item along a single axis through an entirety of the region.

16. The method of claim 12, wherein the transporting comprises resiliently disposing a moving surface, provided by one of the pair of opposing moveable belts, toward the irregularly-shaped produce item and the sheet media effective that the moving surface imparts a rolling action upon the irregularly-shaped produce item along the region.

17. The method of claim 12, wherein the transporting comprises disposing the pair of opposing moveable belts toward the region such that the pair of opposing moveable belts temporarily deform around the irregularly-shaped produce item during the transporting.

18. The method of claim 12, wherein the transporting is achieved with the pair of opposing moveable belts and wherein the pair of opposing moveable belts move in the same direction during the transporting.

* * * * *